US009528374B2

(12) United States Patent
Ikeda et al.

(10) Patent No.: US 9,528,374 B2
(45) Date of Patent: Dec. 27, 2016

(54) TURBOFAN, AND AIR-CONDITIONING APPARATUS

(75) Inventors: Takashi Ikeda, Tokyo (JP); Masahiko Takagi, Tokyo (JP); Makoto Kurihara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 640 days.

(21) Appl. No.: 14/004,177

(22) PCT Filed: Apr. 12, 2011

(86) PCT No.: PCT/JP2011/002141

§ 371 (c)(1),
(2), (4) Date: Sep. 10, 2013

(87) PCT Pub. No.: WO2012/140690

PCT Pub. Date: Oct. 18, 2012

(65) Prior Publication Data

US 2014/0023501 A1 Jan. 23, 2014

(51) Int. Cl.
*F01D 5/22* (2006.01)
*F01D 5/00* (2006.01)
(Continued)

(52) U.S. Cl.
CPC ..... *F01D 5/00* (2013.01); *F04D 29/281* (2013.01); *F04D 29/30* (2013.01); *F04D 29/681* (2013.01)

(58) Field of Classification Search
CPC ..... F04D 29/281; F04D 29/30; F04D 29/225; F04D 29/2255; F01D 5/00
(Continued)

(56) References Cited

U.S. PATENT DOCUMENTS 6,739,835 B2 * 5/2004 Kim ..... F04D 29/30 416/186 R
7,066,712 B2 * 6/2006 Kim ..... F04D 17/165 415/176
(Continued)

FOREIGN PATENT DOCUMENTS

CN 1508440 A 6/2004
CN 101273203 A 9/2008
(Continued)

OTHER PUBLICATIONS

International Search Report of the International Searching Authority mailed Jul. 19, 2011 for the corresponding international application No. PCT/JP2011/002141 (and English translation).
(Continued)

*Primary Examiner* — Eric Keasel
*Assistant Examiner* — Jason Mikus
(74) *Attorney, Agent, or Firm* — Posz Law Group, PLC

(57) ABSTRACT

A turbofan and air-conditioning apparatus that can suppress the separation of an airflow from the surface of each blade, and can reduce noise due to turbulence is obtained. At least one of a blade pressure surface of the blade that is the front surface in the rotation direction, and a blade suction surface of the blade that is the rear surface in the rotation direction has a blade leading edge side jagged portion formed near the blade leading edge portion, the blade leading edge side jagged portion including a recessed portion a extending substantially along the blade inner peripheral side leading edge portion and the blade shroud side leading edge portion and recessed in the thickness direction of the blade, and an inclined portion in which the thickness of the blade gradually increases toward the blade trailing edge portion from the recessed portion.

13 Claims, 8 Drawing Sheets

(51) Int. Cl.
*F04D 29/28* (2006.01)
*F04D 29/30* (2006.01)
*F04D 29/68* (2006.01)

(58) Field of Classification Search
USPC ..... 416/179
See application file for complete search history.

(56) References Cited

U.S. PATENT DOCUMENTS

| | | | | |
|---|---|---|---|---|
| 8,177,484 | B2 * | 5/2012 | Haraguchi | F04D 17/04 415/53.1 |
| 2009/0290986 | A1 | 11/2009 | Haraguchi et al. | |
| 2011/0023526 | A1 * | 2/2011 | Ohyama | F04D 29/30 62/426 |

FOREIGN PATENT DOCUMENTS

| | | | |
|---|---|---|---|
| JP | 63-160400 | U | 10/1988 |
| JP | 07-310696 | A | 11/1995 |
| JP | 2669448 | B2 | 7/1997 |
| JP | 09-280196 | A | 10/1997 |
| JP | 2006-017063 | A | 1/2006 |
| JP | 2008-144667 | A | 6/2008 |
| JP | 2009-133271 | A | 6/2009 |
| JP | 4432474 | B2 | 1/2010 |

OTHER PUBLICATIONS

Office Action issued Mar. 2, 2016 in the corresponding CN application No. 201180070019.8 (with English translation).
Office Action dated Jun. 15, 2015 issued in corresponding CN patent application No. 201180070019.8 (and English translation).
Extended European Search Report mailed on Aug. 26, 2014 in corresponding EP application No. 11863403.9 (in English).
Chinese Office Action dated Sep. 21, 2016 in the corresponding CN application No. 201180070019.8(English translation attached).

* cited by examiner

TURBOFAN, AND AIR-CONDITIONING APPARATUS

CROSS REFERENCE TO RELATED APPLICATION

This application is a U.S. national stage application of International Application No. PCT/JP2011/002141 filed on Apr. 12, 2011.

TECHNICAL FIELD

The present invention relates to a turbofan, and an air-conditioning apparatus including a turbofan.

BACKGROUND ART

In conventional arts, there has been proposed, for example, "an impeller of a centrifugal fan including a plurality of blades, a main plate to which the blades are fixed, and a shroud fixed to end faces of the blades on the side opposite to the main plate, wherein recesses arranged substantially parallel to the axis of rotation are provided in the whole or part of the suction surface of each of the blades, and the width and depth of the recesses gradually increase from the main plate side to the shroud side" (see, for example, Patent Literature 1).

There has been proposed, for example, "an impeller (42) of a centrifugal fan including a plurality of hollow blades (44) annularly disposed around the rotating shaft, each of the hollow blades including a first surface portion (51) integrally molded with or fixed to the main plate and made of resin, and a second surface portion (61) attached to the first surface portion to form a hollow space (S) between itself and the first surface portion and made of resin . . . wherein . . . the end face of the edge portion closest to the second surface portion is in contact with the end face of the second surface portion closest to the first surface portion and thereby forms a blade shape retaining mechanism for preventing the second surface portion from being deformed toward the outer peripheral side by centrifugal force" (see, for example, Patent Literature 2).

CITATION LIST

Patent Literature

Patent Literature 1: Japanese Patent No. 2669448 (Claim 1)
Patent Literature 2: Japanese Patent No. 4432474 (Claim 1)

SUMMARY OF INVENTION

Technical Problem

In the art described in Patent Literature 1, recesses arranged substantially parallel to the axis of rotation are provided in the whole or part of the blade suction surface, and the width and depth of the recesses gradually increase from the main plate side to the shroud side. Therefore, if an airflow flowing close to the surface of the blade suction surface tries to separate from the surface of the blade, the amount of air in the recesses provided in the surface of the blade decreases, a negative pressure is formed in the recesses, the airflow that is about to separate is pulled back, and occurrence of separation is suppressed.

However, since the recesses are substantially parallel to the axis of rotation, the recesses are substantially perpendicular to the blade leading edge portion on the side facing the fan air inlet (shroud side) of the blade leading edge portion. Therefore, there is a problem that the airflow pull-back effect in the recesses cannot be obtained on the side facing the fan air inlet (shroud side). Therefore, there is a problem that an airflow separates from the surface of the blade, and noise due to turbulence increases.

Further, there is a problem that since the cross section of the recesses is substantially hemispherical, when the flow reattaches to the downstream side of the recesses, the flow collides with the downstream corners of the recesses and separates, pressure fluctuation occurs, and noise increases.

In the art described in Patent Literature 2, the pressure surface side portion and the suction surface side portion of each blade are separate bodies, a hollow blade is formed by bringing the surfaces into contact with each other, and it has a blade shape retaining mechanism for preventing deformation due to centrifugal force.

However, there is a problem that if there is a gap between the blade pressure surface side portion and the blade suction surface side portion, or either is fixed so as to protrude relative to the flow, the flow separates in the protruding place, and noise due to turbulence increases.

The present invention has been made to solve the above problems, and intended to obtain a turbofan and air-conditioning apparatus that can suppress the separation of an airflow from the surface of each blade, and can reduce noise due to turbulence.

Solution to Problem

A turbofan according to the present invention includes a circular main plate to be rotationally driven, an annular shroud disposed so as to face the main plate, and a plurality of blades that are each connected to the main plate at one end and to the shroud at the other end and that are disposed to be spaced apart in the circumferential direction of the main plate. The blades each have a blade trailing edge portion located on the outer peripheral side of the main plate, and a blade leading edge portion located closer to the center of rotation of the main plate than the blade trailing edge portion. A part of the blade leading edge portion close to the main plate forms a blade inner peripheral side leading edge portion that is substantially perpendicular to the main plate. A part of the blade leading edge portion close to the shroud forms a blade shroud side leading edge portion that extends in such an inclined manner that the more distant from the main plate, the closer to the blade trailing edge portion. At least one of a pressure surface of the blade that is the front surface in the rotation direction, and a suction surface of the blade that is the rear surface in the rotation direction has a blade leading edge side jagged portion formed near the blade leading edge portion, the blade leading edge side jagged portion including a recessed portion extending substantially along the blade inner peripheral side leading edge portion and the blade shroud side leading edge portion and recessed in the thickness direction of the blade, and an inclined portion in which the thickness of the blade gradually increases toward the blade trailing edge portion from the recessed portion.

Advantageous Effects of Invention

The present invention can suppress the separation of an airflow from the surface of each blade, and can reduce noise due to turbulence.

DESCRIPTION OF EMBODIMENTS

Embodiment 1

Figure 1:
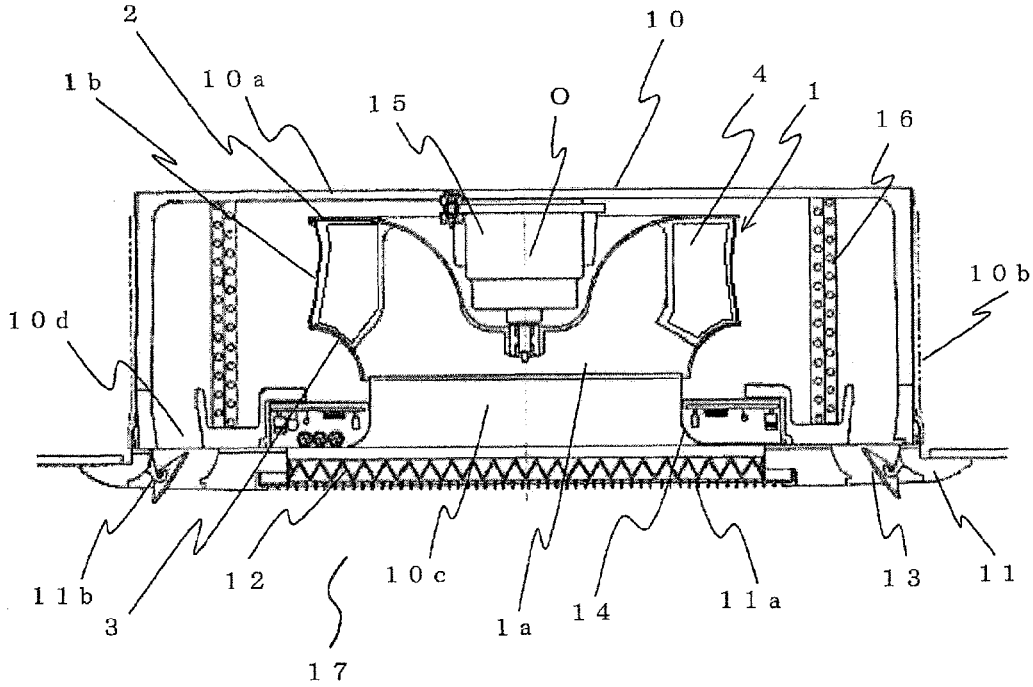
FIG. 1 is a vertical sectional view of an air-conditioning apparatus exhibiting Embodiment 1.

FIG. 1 is a vertical sectional view of an air-conditioning apparatus exhibiting Embodiment 1.

While a ceiling concealed air-conditioning apparatus will be used as an example to describe Embodiment 1, the present invention is not limited to this. The present invention may be widely applicable to air-conditioning apparatuses including a turbofan having pressure loss members that allow air to flow therethrough, such as a filter and a heat exchanger, at the air inlet side and the air outlet side of the fan.

As shown in FIG. 1, an air-conditioning apparatus main body 10 is installed in a room 17 with a top plate 10*a* facing upward. A side plate 10*b* is attached around the top plate 10*a*, and is installed so as to be open toward the room 17. A decorative panel 11 that is substantially quadrilateral in plan view is attached to the underside of the air-conditioning apparatus main body 10 and faces the room 17. The decorative panel 11 has, near the center thereof, an air inlet grille 11*a* through which air is taken into the air-conditioning apparatus main body 10, and a filter 12 that removes dust from air passing through the air inlet grille 11*a*. On each side of the decorative panel 11, a panel air outlet 11*b* serving as an air outlet is formed along each side of the decorative panel 11. Each panel air outlet 11*b* is provided with an air-directing vane 13.

The air-conditioning apparatus main body 10 has therein a turbofan 1, a bell mouth 14 that forms an intake air path of the turbofan 1, a fan motor 15 that rotationally drives the turbofan 1, and a heat exchanger 16 erected downstream of the turbofan 1 so as to surround the turbofan 1. The heat exchanger 16 is connected to an outdoor unit (not shown) by a connection pipe, and refrigerant is circulated.

The air-conditioning apparatus main body 10 has a main body air inlet 10*c* in the center of the lower surface thereof, and a main body air outlet 10*d* around the main body air inlet 10*c*. The air inlet grille 11*a*, the main body air inlet 10*c*, the main body air outlet 10*d*, and the panel air outlets 11*b* communicate with each other.

The "main body air inlet 10*c*" corresponds to an "air inlet" in the present invention.

The "panel air outlets 11*b*" correspond to an "air outlet" in the present invention.

The "top plate 10*a*" and the "side plate 10*b*" correspond to a "casing" in the present invention.

By the air-conditioning apparatus configured as above, when the turbofan 1 rotates, air in the room 17 is taken in through the air inlet grille 11*a* of the decorative panel 11, and passes through the filter 12, where dust is removed. The air from which dust is removed passes through the main body air inlet 10*c* and the bell mouth 14 and is then taken into the fan air inlet 1*a* of the turbofan 1. The air taken into the turbofan 1 is blown out through a fan air outlet 1*b* of the turbofan 1 toward the heat exchanger 16.

The air blown out toward the heat exchanger 16 exchanges heat with the refrigerant in the heat exchanger 16 and becomes heated, cooled, or dehumidified air. The air heated, cooled, or dehumidified in the heat exchanger 16 passes through the main body air outlet 10*d* and is blown out through the panel air outlets 11*b* to the room 17, and air conditioning is performed. At this time, the direction of air is controlled by the air-directing vanes 13.

Next, the turbofan 1 mounted in the air-conditioning apparatus will be described.

Figure 2:
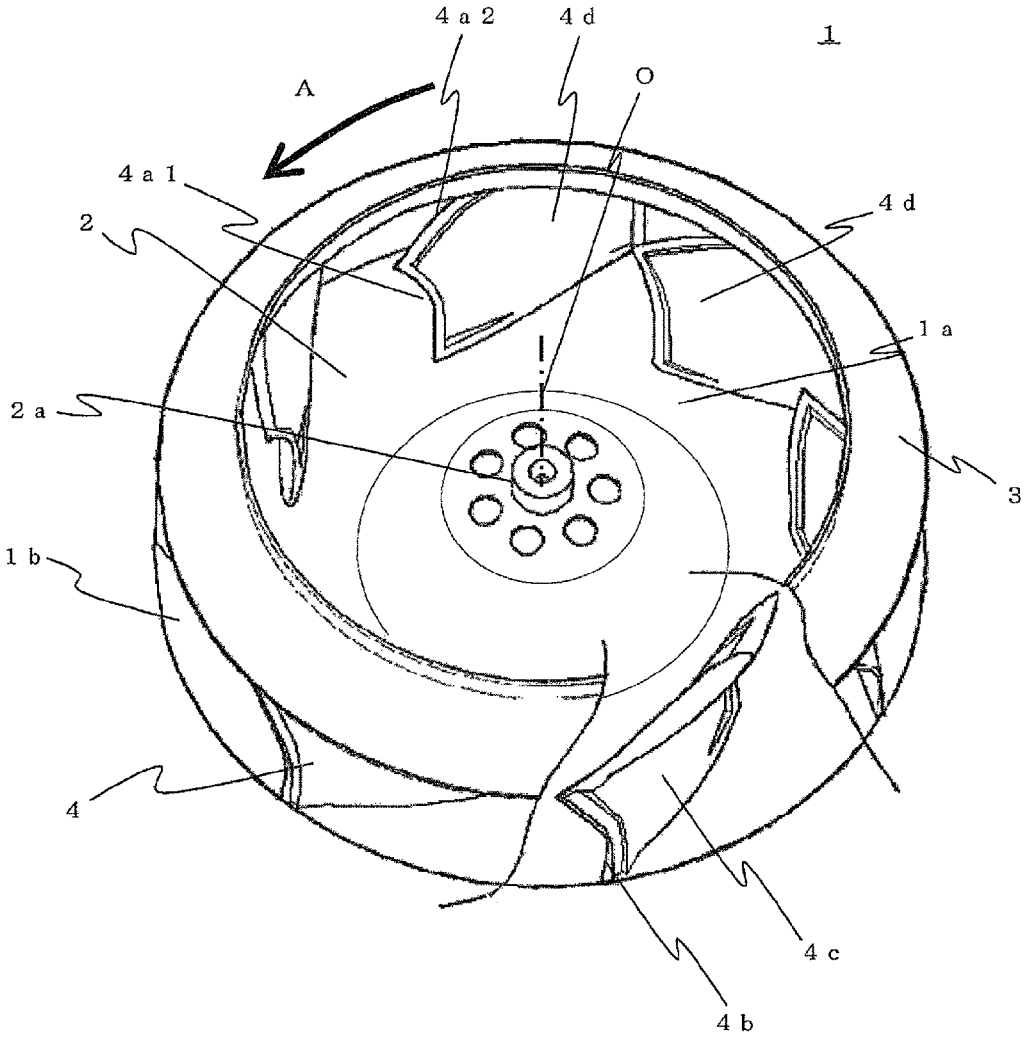
FIG. 2 is a perspective view of the turbofan of FIG. 1.

FIG. 2 is a perspective view of the turbofan of FIG. 1.

Figure 3:
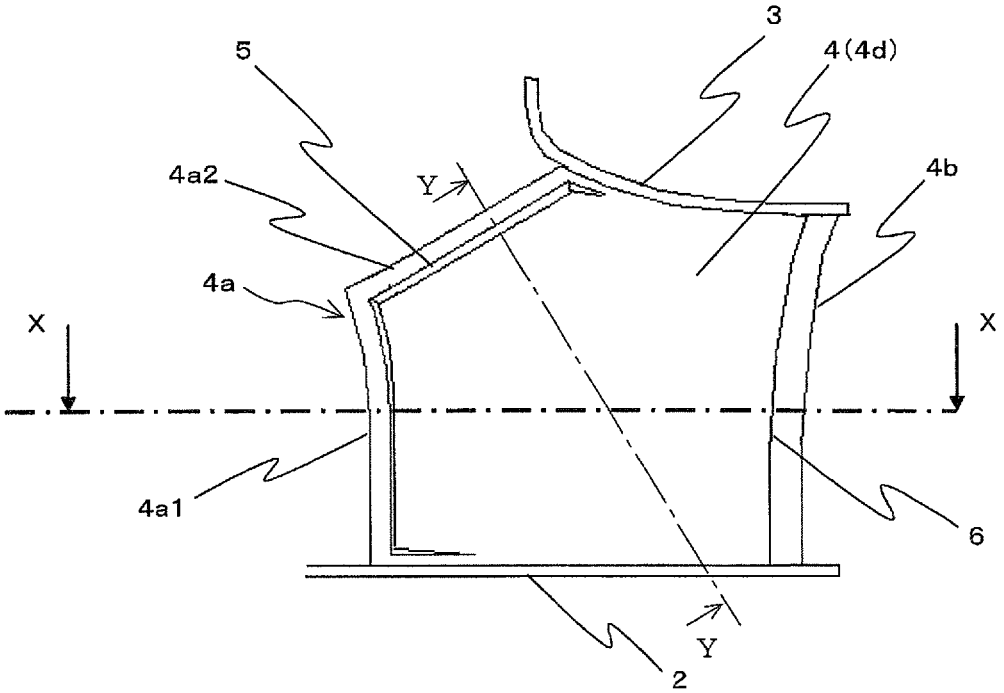
FIG. 3 is a suction surface side view of one of the blades of the turbofan of FIG. 1.

FIG. 3 is a suction surface side view of one of the blades of the turbofan of FIG. 1.

Figure 4:
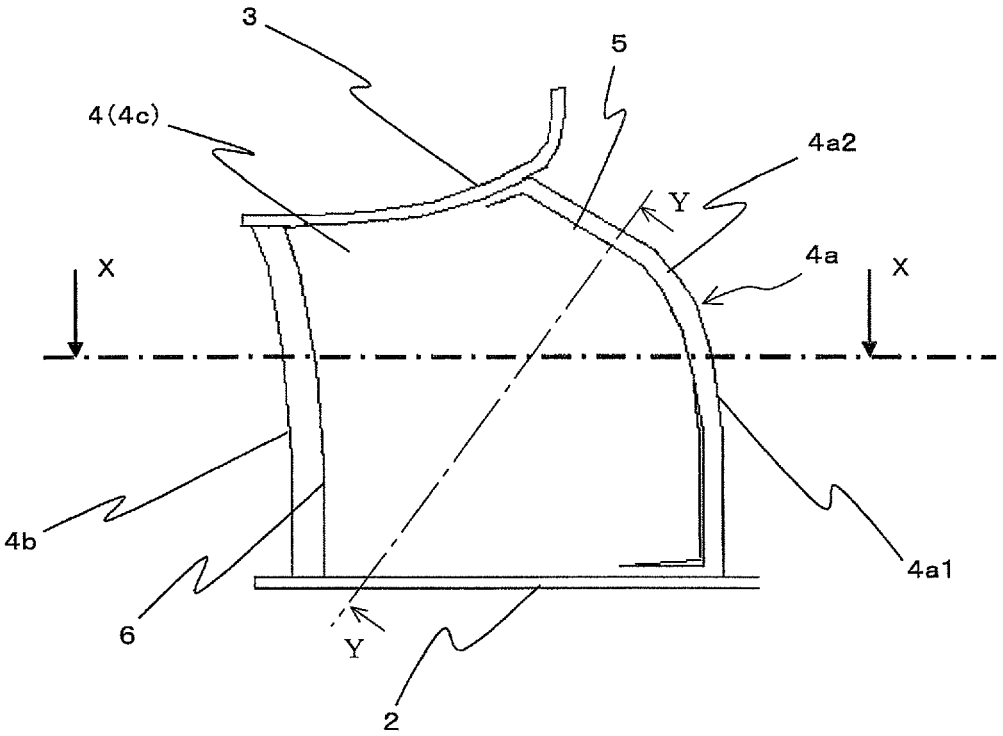
FIG. 4 is a pressure surface side view of one of the blades of the turbofan of FIG. 1.

FIG. 4 is a pressure surface side view of one of the blades of the turbofan of FIG. 1.

In FIG. 2 to FIG. 4, in order to facilitate understanding, the room 17 side faces upward in the figure. That is, air is taken in from the top of the figure to the bottom of the figure. In FIG. 2, in order to facilitate understanding, a state where the shroud 3 is partly removed is depicted. In the figures, the same or corresponding parts are denoted by the same reference signs, and a part of the description will be omitted.

As shown in FIG. 2, the turbofan 1 includes a circular main plate 2 rotationally driven in the fan rotation direction A, an annular shroud 3 disposed so as to face the main plate 2, and a plurality of blades 4 that are each connected to the main plate 2 at one end and to the shroud 3 at the other end and that are disposed to be spaced apart in the circumferential direction of the main plate 2.

The main plate 2 is a hat-shaped rotating body having a flat outer peripheral portion and a central portion protruding toward the fan air inlet 1*a*. A boss 2*a* is formed in the center of the main plate 2. The boss 2*a* is fixed to the rotating shaft of the fan motor 15. Hereinafter, the center of the rotating shaft of the main plate 2 will be referred to as "rotation axis O."

The upper edge of the shroud 3 forms the fan air inlet 1*a*, and the internal diameter of the shroud 3 increases such that the more downward from the fan air inlet 1*a* (toward the main plate 2), the greater the internal diameter is.

The lower edge of the shroud 3, the main plate 2 facing this, and the blade trailing edge portions 4*b* of the blades 4 form the fan air outlet 1*b*.

As shown in FIG. 2 to FIG. 4, the blades 4 each have a blade trailing edge portion 4*b* located on the outer peripheral side of the main plate 2, and a blade leading edge portion 4*a* located closer to the center of rotation of the main plate 2 than the blade trailing edge portion 4*b*.

The blade leading edge portion 4*a* is located in front of the blade trailing edge portion 4*b* in the fan rotation direction A, and a chord line connecting the blade leading edge portion 4*a* and the blade trailing edge portion 4*b* is inclined to a radial line from the rotation axis O.

A part of the blade leading edge portion 4*a* close to the main plate 2 forms a blade inner peripheral side leading edge portion 4*a*1 that is substantially perpendicular to the main plate 2 in side view. A part of the blade leading edge portion 4*a* close to the shroud 3 forms a blade shroud side leading edge portion 4*a*2 that extends in such an inclined manner that the more distant from the main plate 2, the closer to the blade trailing edge portion 4*b* in side view.

In addition, in the blade leading edge portion 4*a* of each blade 4, the shroud side of the blade inner peripheral side leading edge portion 4*a*1 and the blade shroud side leading edge portion 4*a*2 are curved in the fan rotation direction A and toward the radially outer side of the main plate 2.

The blade trailing edge portion 4*b* is formed substantially perpendicularly to the main plate 2 in side view.

In addition, the shroud 3 side of the blade trailing edge portion 4*b* is curved in a direction opposite to the fan rotation direction A compared to the main plate 2 side.

While, in Embodiment 1, a case where the blades 4 are curved will be described, the present invention is not limited to this. For example, the blades 4 may be formed in a substantially flat-plate shape in plan view.

Figure 5:
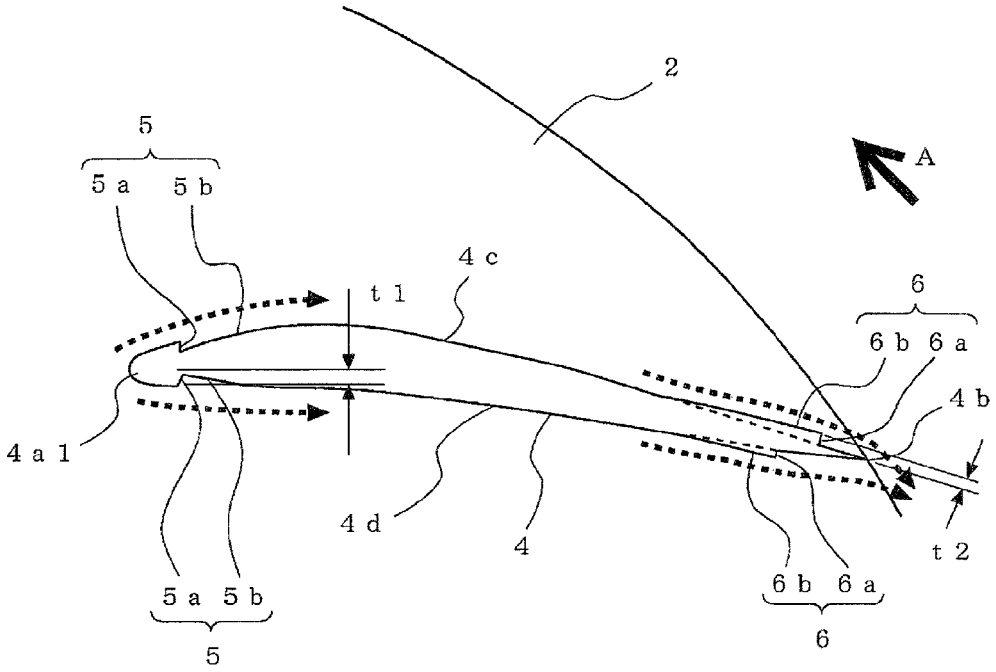
FIG. 5 is a blade horizontal sectional view taken along line X-X of FIG. 3 and FIG. 4, perpendicularly to the fan rotation axis.

FIG. 5 is a blade horizontal sectional view taken along line X-X of FIG. 3 and FIG. 4, perpendicularly to the fan rotation axis.

Figure 6:
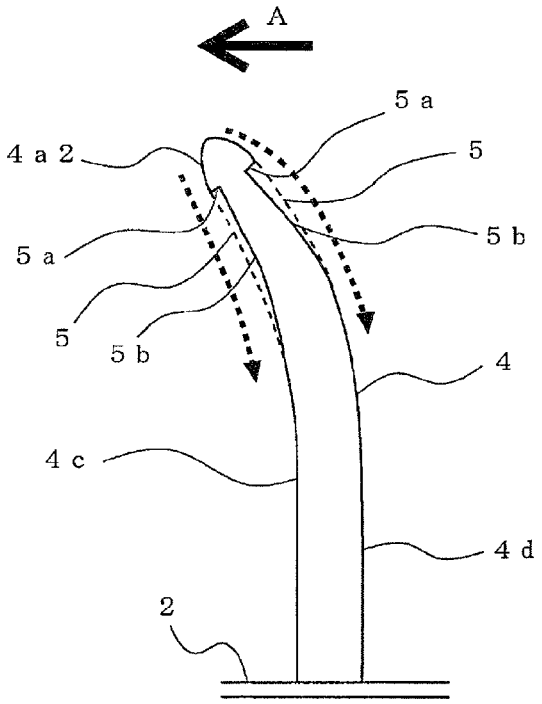
FIG. 6 is a blade sectional view taken along line Y-Y of FIG. 3 and FIG. 4, substantially perpendicularly to the fan air inlet side leading edge portion.

FIG. 6 is a blade sectional view taken along line Y-Y of FIG. 3 and FIG. 4, substantially perpendicularly to the fan air inlet side leading edge portion.

As shown in FIG. 5, in the X-X section perpendicular to the rotation axis O, the blades 4 have such a basic shape that the thickness gradually increases from the blade leading edge portion 4*a* toward the radially outer side of the main plate 2, and after reaching the maximum thickness, the thickness gradually decreases toward the blade trailing edge portion 4*b*.

As shown in FIG. 5 and FIG. 6, a blade pressure surface 4*c* of the blade 4 that is the front surface in the fan rotation direction A, and a blade suction surface 4*d* of the blade 4 that is the rear surface in the fan rotation direction A each have a blade leading edge side jagged portion 5 formed near the blade leading edge portion 4*a*.

The blade leading edge side jagged portion 5 includes a recessed portion 5*a* extending substantially along the blade inner peripheral side leading edge portion 4*a*1 and the blade shroud side leading edge portion 4*a*2 and recessed in the thickness direction of the blade 4, and an inclined portion 5*b* in which the thickness of the blade 4 gradually increases toward the blade trailing edge portion 4*b* from the recessed portion 5*a* (toward the downstream side). The recessed portion 5*a* is formed so as to have a predetermined height t1 in the thickness direction.

The blade pressure surface 4*c* and the blade suction surface 4*d* each have a blade trailing edge side jagged portion 6 formed near the blade trailing edge portion 4*b*.

The blade trailing edge side jagged portion 6 includes a protruding portion 6*a* extending substantially along the blade trailing edge portion 4*b* and protruding in the thickness direction of the blade 4, and an inclined portion 6*b* in which the thickness of the blade 4 gradually reduces toward the blade leading edge portion 4*a* from the protruding portion 6*a* (toward the upstream side). The protruding portion 6*a* is formed so as to have a predetermined height t2 in the thickness direction.

The "inclined portion 6*b*" corresponds to a "second inclined portion" in the present invention.

While, in Embodiment 1, the blade pressure surface 4*c* and the blade suction surface 4*d* each have a blade leading edge side jagged portion 5 formed therein, the present invention is not limited to this. At least one of the blade pressure surface 4*c* and the blade suction surface 4*d* may have a blade leading edge side jagged portion 5 formed therein.

While, in Embodiment 1, the blade pressure surface 4*c* and the blade suction surface 4*d* each have a blade trailing edge side jagged portion 6 formed thereon, the present invention is not limited to this. At least one of the blade pressure surface 4*c* and the blade suction surface 4*d* may have a blade trailing edge side jagged portion 6 formed thereon.

In Embodiment 1, a blade leading edge side jagged portion 5 is formed near the blade leading edge portion 4*a*, and a blade trailing edge side jagged portion 6 is formed near the blade trailing edge portion 4*b*. However, the present invention is not limited to this. Only one of a blade leading edge side jagged portion 5 and a blade trailing edge side jagged portion 6 may be formed.

As described above, in Embodiment 1, at least one of the blade pressure surface 4*c* and the blade suction surface 4*d* has a blade leading edge side jagged portion 5 formed near the blade leading edge portion 4*a*. The blade leading edge side jagged portion 5 includes a recessed portion 5*a* extending substantially along the blade inner peripheral side leading edge portion 4*a*1 and the blade shroud side leading edge portion 4*a*2 and recessed in the thickness direction of the blade 4, and an inclined portion 5*b* in which the thickness of the blade 4 gradually increases toward the blade trailing edge portion 4*b* from the recessed portion 5*a*.

Therefore, in the entire blade leading edge portion 4*a*, the separation at the time of airflow reattachment at the downstream end of the recessed portion 5*a* of the blade leading edge side jagged portion 5 is prevented, and a pull-back effect can thereby be obtained. Therefore, the separation of an airflow from the surface of the blade 4 can be suppressed, and noise due to turbulence can be reduced.

In addition, if the ventilation resistance on the fan air inlet 1*a* side increases, for example, owing to the deposition of dust on the filter 12, the separation of an airflow from the surface of the blade 4 can be suppressed. Therefore, if the ventilation resistance increases, low noise is maintained.

As a result of the above, a noiseless air-conditioning apparatus can be obtained, and an air-conditioning apparatus in which if the ventilation resistance is changed by dust or the like, noise is less likely to increase and that is reliable can be obtained.

In Embodiment 1, at least one of the blade pressure surface 4*c* and the blade suction surface 4*d* has a blade trailing edge side jagged portion 6 formed near the blade trailing edge portion 4*b*. The blade trailing edge side jagged portion 6 includes a protruding portion 6*a* extending substantially along the blade trailing edge portion 4*b* and protruding in the thickness direction of the blade 4, and an inclined portion 6*b* in which the thickness of the blade 4 gradually reduces toward the blade leading edge portion 4*a* from the protruding portion 6*a*.

Therefore, the flow of air on the surface of the blade 4 is pulled back to the blade trailing edge portion 4*b* by negative pressure generated by the blade trailing edge side jagged portion 6, thereby the width of the trailing vortex emitted from the blade trailing edge portion 4*b* to the outside is reduced, turbulence is suppressed, and pressure fluctuation is reduced.

Further, the disturbance created in the flow of air flowing into the heat exchanger 16 disposed downstream of the turbofan 1 can be suppressed. Therefore, the increase in noise caused by the fact that the heat exchanger 16 is subjected to pressure fluctuation can be suppressed.

As a result of the above, a noiseless air-conditioning apparatus can be obtained, and an air-conditioning apparatus in which if the ventilation resistance is changed by dust or the like, noise is less likely to increase and that is reliable can be obtained.

Embodiment 2

In Embodiment 2, an embodiment will be described in which at least one of the blade pressure surface 4*c* and the blade suction surface 4*d* of each blade 4 is formed by a separate member.

Except for the configuration of each blade 4 of the turbofan 1, Embodiment 2 is the same as Embodiment 1, and the same reference signs will be used to designate the same parts.

Figure 7:
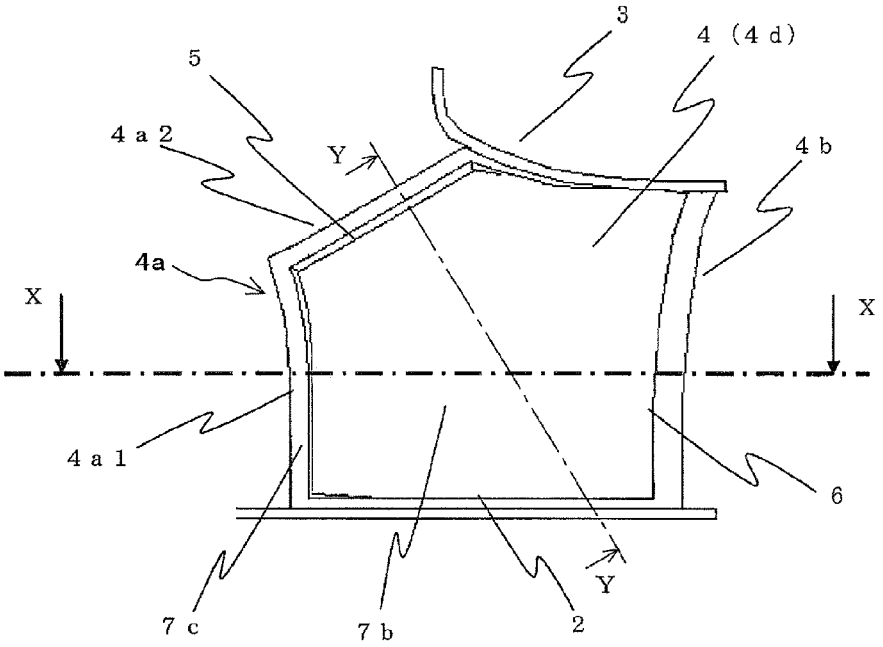
FIG. 7 is a view corresponding to FIG. 3 of a turbofan 1 mounted in an air-conditioning apparatus exhibiting Embodiment 2.

FIG. 7 is a view corresponding to FIG. 3 of a turbofan 1 mounted in an air-conditioning apparatus exhibiting Embodiment 2.

Figure 8:
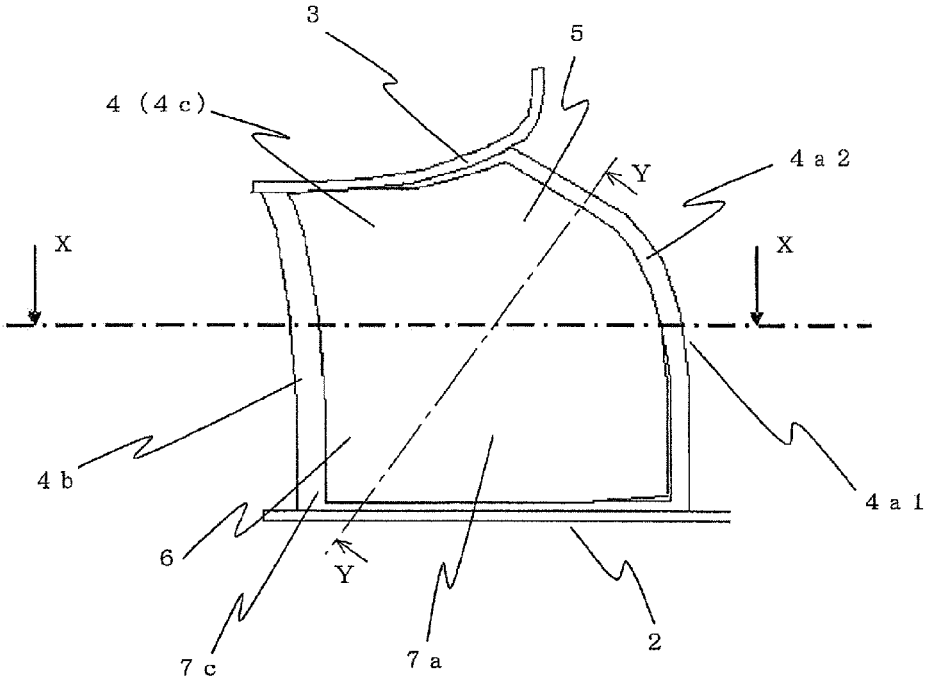
FIG. 8 is a view corresponding to FIG. 4 of the turbofan 1 mounted in an air-conditioning apparatus exhibiting Embodiment 2.

FIG. 8 is a view corresponding to FIG. 4 of the turbofan 1 mounted in an air-conditioning apparatus exhibiting Embodiment 2.

Figure 9:
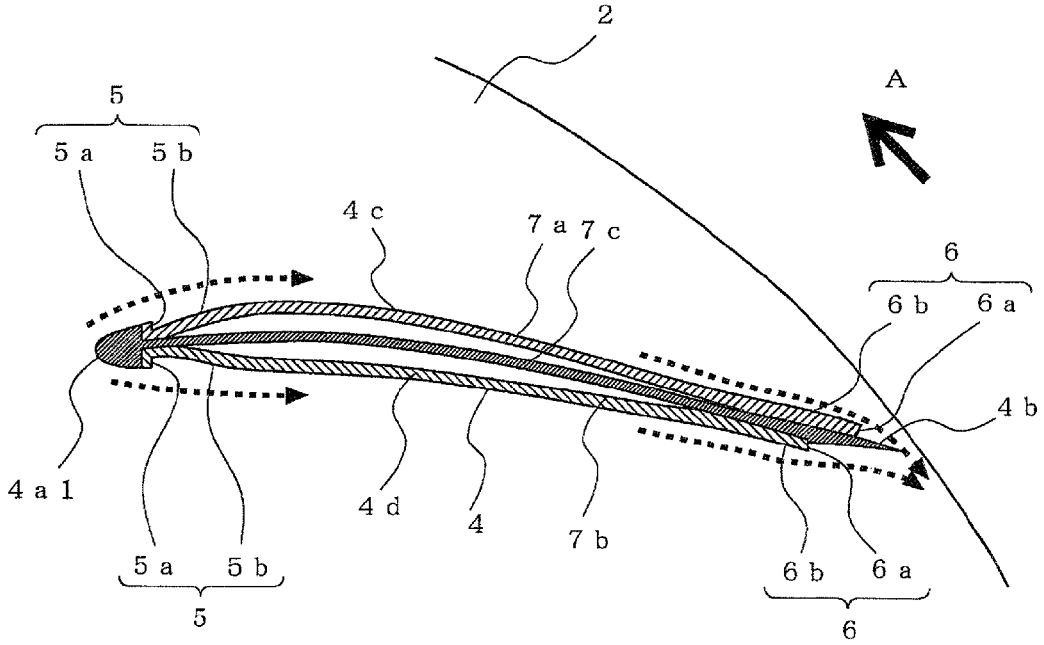
FIG. 9 is a view corresponding to FIG. 5 of the turbofan 1 mounted in an air-conditioning apparatus exhibiting Embodiment 2.

FIG. 9 is a view corresponding to FIG. 5 of the turbofan 1 mounted in an air-conditioning apparatus exhibiting Embodiment 2.

Figure 10:
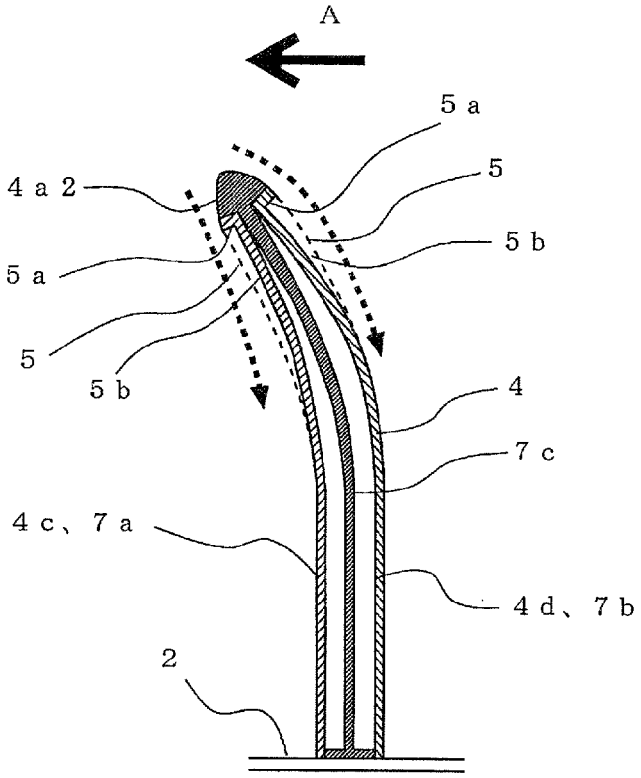
FIG. 10 is a view corresponding to FIG. 6 of the turbofan 1 mounted in an air-conditioning apparatus exhibiting Embodiment 2.

FIG. 10 is a view corresponding to FIG. 6 of the turbofan 1 mounted in an air-conditioning apparatus exhibiting Embodiment 2.

As shown in FIG. 7 to FIG. 10, a part from the vicinity of the blade leading edge portion 4*a* to the vicinity of the blade trailing edge portion 4*b* of each of the blade pressure surface 4*c* and the blade suction surface 4*d* of each blade 4 of the turbofan in Embodiment 2 is formed by a separate member. Specifically, a part from the blade leading edge side jagged portion 5 to the blade trailing edge side jagged portion 6 on the blade pressure surface 4*c* side is formed by a blade pressure surface side separate member 7*a*. A part from the blade leading edge side jagged portion 5 to the blade trailing edge side jagged portion 6 on the blade suction surface 4*d* side is formed by a blade suction surface side separate member 7*b*.

The blade pressure surface side separate member 7*a* and the blade suction surface side separate member 7*b* are fitted in, fixed to, and thereby integrated with a blade frame portion 7*c* formed by the blade leading edge portion 4*a*, the blade trailing edge portion 4*b*, and a beam member that connects the blade leading edge portion 4*a* and the blade trailing edge portion 4*b* and that is thinner than the thickness of the blade 4, and the blade 4 is thereby formed.

Further, the blade pressure surface side separate member 7*a* and the blade suction surface side separate member 7*b* are fitted in the blade frame portion 7*c* in such a manner that a gap is formed between each separate member and the beam member, and hollow spaces are thereby formed within the blade.

While, in Embodiment 2, the blade pressure surface 4*c* and the blade suction surface 4*d* are each formed by a separate member, the present invention is not limited to this. At least one of the blade pressure surface 4*c* and the blade suction surface 4*d* may be formed by a separate member.

As described above, in Embodiment 2, a part from the vicinity of the blade leading edge portion 4*a* to the vicinity of the blade trailing edge portion 4*b* of at least one of the blade pressure surface 4*c* and the blade suction surface 4*d* is formed by a separate member, the separate member is fitted in a blade frame portion 7*c* formed by the blade leading edge portion 4*a*, the blade trailing edge portion 4*b*, and a beam member that connects the blade leading edge portion 4*a* and the blade trailing edge portion 4*b* and that is thinner than the thickness of the blade 4, and the blade 4 is thereby formed.

Therefore, in addition to the effects of Embodiment 1, the blade 4 and the separate member are not formed in the same surface, the separate member does not protrude in the blade leading edge portion 4*a* owing to defective fitting, and the separation of flow can be suppressed. Further, the separate member is not recessed relative to the blade 4 in the blade trailing edge portion 4*b*, and it is possible to suppress the separation of airflow in the blade trailing edge portion 4*b*, to suppress the increase in trailing vortex width, and to reduce noise due to turbulence. Thus, a high-quality turbofan and air-conditioning apparatus can be obtained.

As a result of the above, according to the present invention, a noiseless, lightweight, and high-quality turbofan and air-conditioning apparatus can be obtained.

Further, in Embodiment 2, the separate members are fitted in the blade frame portion 7*c* in such a manner that a gap is formed between each separate member and the beam member, and hollow spaces are thereby formed within the blade.

Therefore, the inside of the blade 4 is hollow, and it is possible to reduce the material of the blade 4, and to reduce the weight. Therefore, a lightweight turbofan and air-conditioning apparatus can be obtained.

Embodiment 3

In Embodiment 3, an embodiment will be described in which the blade leading edge side jagged portion 5 and the blade trailing edge side jagged portion 6 are formed in a plurality of cutout shapes.

Except for the configuration of each blade 4 of the turbofan 1, Embodiment 3 is the same as Embodiment 1, and the same reference signs will be used to designate the same parts.

Figure 11:
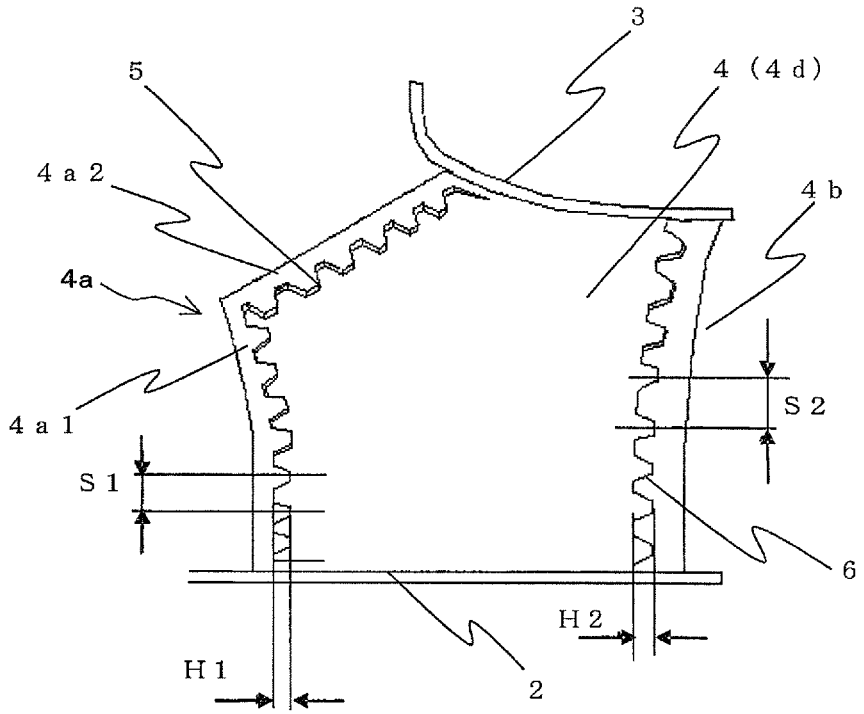
FIG. 11 is a view corresponding to FIG. 3 of a turbofan mounted in an air-conditioning apparatus exhibiting Embodiment 3.

FIG. 11 is a view corresponding to FIG. 3 of a turbofan mounted in an air-conditioning apparatus exhibiting Embodiment 3.

Figure 12:
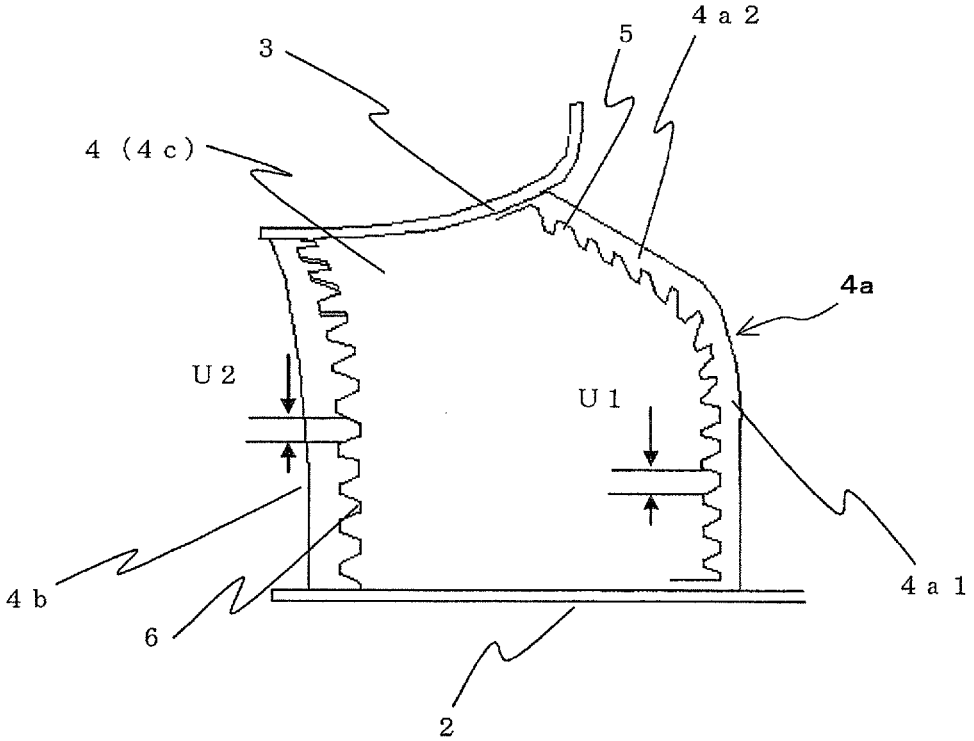
FIG. 12 is a view corresponding to FIG. 4 of the turbofan mounted in an air-conditioning apparatus exhibiting Embodiment 3.

FIG. 12 is a view corresponding to FIG. 4 of the turbofan mounted in an air-conditioning apparatus exhibiting Embodiment 3.

As shown in FIG. 11 and FIG. 12, in each blade 4 in Embodiment 3, in addition to the configuration of Embodiment 1, the recessed portion 5*a* of the blade leading edge side jagged portion 5 has a plurality of cutout shapes consecutively formed and alternately protruded and recessed in a direction substantially perpendicular to the blade leading edge portion 4*a*. This plurality of cutout shapes are formed so as to have a predetermined pitch S1 in a direction along the blade leading edge portion 4*a*, a predetermined length H1 in a direction perpendicular to the blade leading edge portion 4*a*, a predetermined cutout width U1 of the recessed portion 5*a*, and a predetermined height t1 in the thickness direction of the recessed portion 5*a*. With respect to a direction perpendicular to the blade leading edge portion 4*a*, an oblique portion whose cutout width decreases toward one end and a flat portion along the blade leading edge portion 4*a* form a shape extending in a substantially trapezoidal shape in side view.

The protruding portion 6*a* of the blade trailing edge side jagged portion 6 has a plurality of cutout shapes consecutively formed and alternately protruded and recessed in a direction substantially perpendicular to the blade trailing edge portion 4*b*. These plurality of cutout shapes are formed so as to have a predetermined pitch S2 in a direction along the blade trailing edge portion 4*b*, a predetermined length H2 in a direction perpendicular to the blade trailing edge portion 4*b*, a predetermined cutout width U2 of the protruding portion 6*a*, and a predetermined height t2 in the thickness direction of the protruding portion 6*a*. With respect to a direction perpendicular to the blade trailing edge portion 4*b*, an oblique portion whose cutout width decreases toward one end and a flat portion along the blade trailing edge portion 4*b* form a shape extending in a substantially trapezoidal shape in side view.

While, in Embodiment 3, the blade leading edge side jagged portion 5 and the blade trailing edge side jagged portion 6 each have a plurality of cutout shapes, the present invention is not limited to this. At least one of the blade leading edge side jagged portion 5 and the blade trailing edge side jagged portion 6 may have a plurality of cutout shapes.

As described above, in Embodiment 3, the recessed portion 5*a* of the blade leading edge side jagged portion 5 has a plurality of cutout shapes consecutively formed and alternately protruded and recessed in a direction substantially perpendicular to the blade leading edge portion 4*a*.

Therefore, when an airflow flowing on the surface of the blade 4 passes over the blade leading edge side jagged portion 5 and reattaches to the inclined portion 5*b* or the blade surface owing to the negative pressure generated in the recessed portion 5*a*, the position where the negative pressure is generated differs in a direction along the blade leading edge portion 4*a*, between adjacent cutout portions. Thus, the timing of reattachment to the blade surface is shifted in a direction along the blade leading edge portion 4*a*, regularity disappears, the pressure fluctuation is further reduced, and separation becomes less likely to occur. Therefore, a turbofan and an air-conditioning apparatus that are capable of noise reduction and that are more noiseless can be obtained.

In Embodiment 3, the protruding portion 6*a* of the blade trailing edge side jagged portion 6 has a plurality of cutout shapes consecutively formed and alternately protruded and recessed in a direction substantially perpendicular to the blade trailing edge portion 4*b*.

Therefore, when an airflow flowing on the surface of the blade 4 is pulled back to the blade trailing edge portion 4*b* by the negative pressure generated by the blade trailing edge side jagged portion 6, the position where the negative pressure is generated differs in a direction along the blade trailing edge portion 4*b*, between adjacent cutout portions. Thus, the timing of reattachment to the blade surface is shifted in a direction along the blade trailing edge portion 4*b*, regularity disappears, the pressure fluctuation is further reduced, and separation becomes less likely to occur. Therefore, a turbofan and an air-conditioning apparatus that are capable of noise reduction and that are more noiseless can be obtained.

Figure 13:
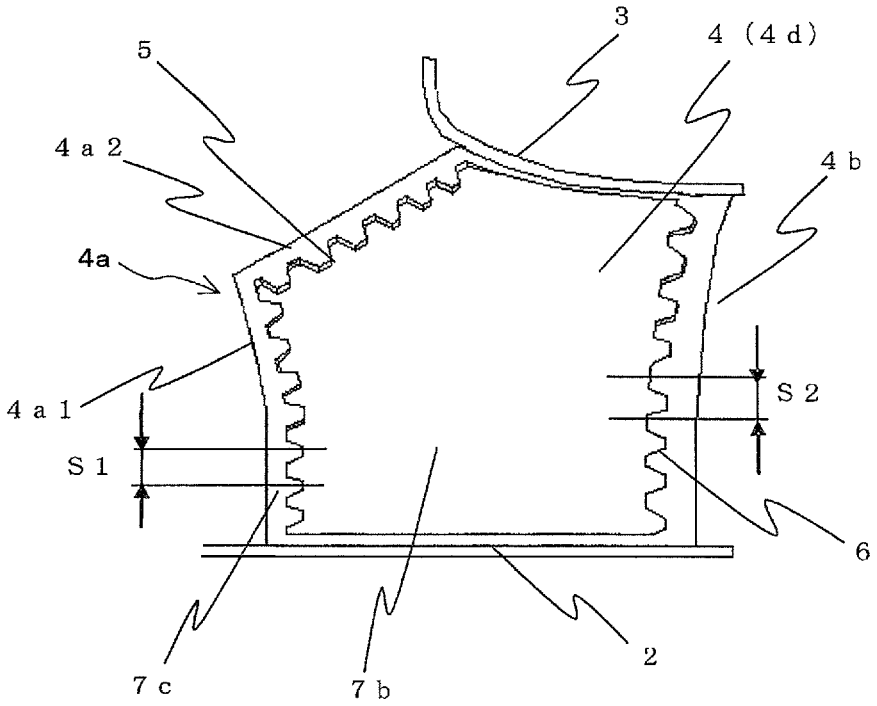
FIG. 13 is a view corresponding to FIG. 5 of a turbofan mounted in an air-conditioning apparatus showing another example of Embodiment 3.
Figure 14:
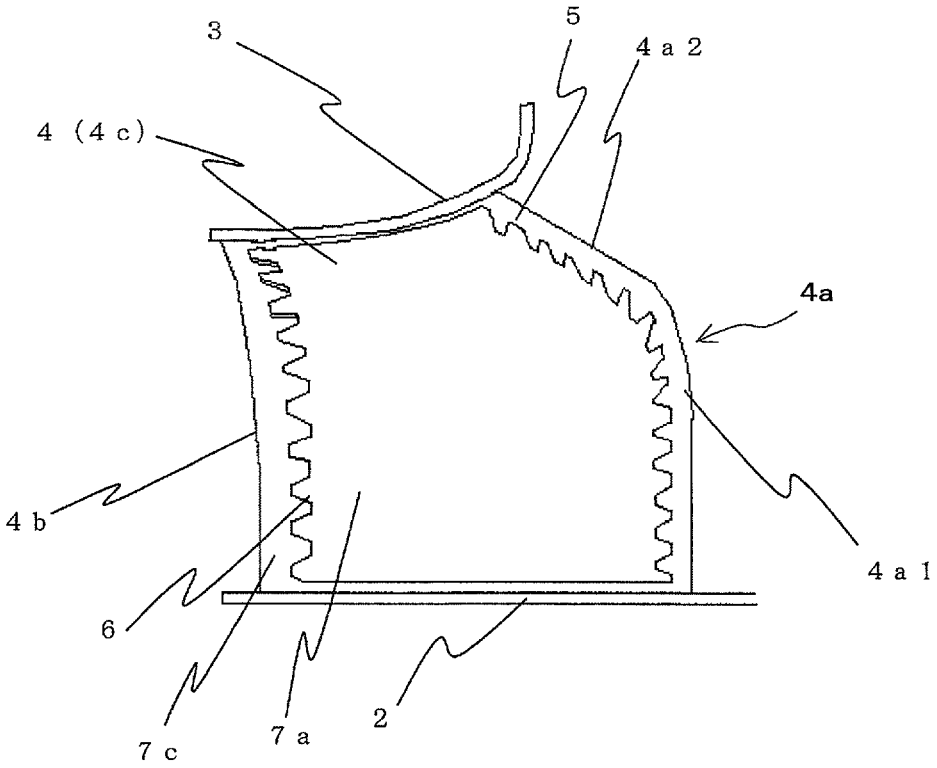
FIG. 14 is a view corresponding to FIG. 6 of the turbofan mounted in an air-conditioning apparatus showing the other example of Embodiment 3.

As shown in FIG. 13 and FIG. 14, in addition to the configuration of Embodiment 2, a plurality of cutout shapes may be consecutively formed in each of the blade leading edge side jagged portion 5 and the blade trailing edge side jagged portion 6.

Specifically, the junction of the blade leading edge portion 4*a* and the blade pressure surface side separate member 7*a*, and the junction of the blade leading edge portion 4*a* and the blade suction surface side separate member 7*b* each have the above-described plurality of cutout shapes, and the separate members are fitted in and fixed. The junction of the blade trailing edge portion 4*b* and the blade pressure surface side separate member 7*a*, and the junction of the blade trailing edge portion 4*b* and the blade suction surface side separate member 7*b* each have the above-described plurality of cutout shapes, and the separate members are fitted in and fixed.

Therefore, in addition to the above-described effects, if owing to defective assembly of the separate members or the like, the separate members are protruded relative to the blade leading edge portion 4*a* and separation of an airflow occurs in the blade leading edge portion 4*a*, or the separate members are recessed in the blade trailing edge portion 4*b* and separation occurs in the blade trailing edge portion 4*b*, the separation vortex is diffused by the plurality of cutout shapes, therefore the airflow reattaches to the surface of the blade 4, and the increase in noise can thereby be suppressed. That is, a reliable turbofan and air-conditioning apparatus can be obtained.

While, in Embodiment 3, a case where the plurality of cutout shapes has a substantially trapezoidal shape in side view has been described, the present invention is not limited to this. The plurality of cutout shapes may have, for example, in side view, a substantially triangular shape whose cutout width decreases toward one end.

As described above, thanks to a shape whose cutout width increases at least gradually in the recessed portion 5*a*, the flow reattaching to the surface of the blade 4 from the blade leading edge side jagged portion 5 does not concentrate in the center of the cutout, the flow of air is diffused, and therefore noise can be suppressed.

INDUSTRIAL APPLICABILITY

The turbofan according to the present invention can be widely mounted in air-conditioning apparatuses and other various apparatuses having an air-sending means.

REFERENCE SIGNS LIST

1 turbofan, 1*a* fan air inlet, 1*b* fan air outlet, 2 main plate, 2*a* boss, 3 shroud, 4 blade, 4*a* blade leading edge portion, 4*a*1 blade inner peripheral side leading edge portion, 4*a*2 blade shroud side leading edge portion, 4*b* blade trailing edge portion, 4*c* blade pressure surface, 4*d* blade suction surface, 5 blade leading edge side jagged portion, 5*a* recessed portion, 5*b* inclined portion, 6 blade trailing edge side jagged portion, 6*a* protruding portion, 6*b* inclined portion, 7*a* blade pressure surface side separate member, 7*b* blade suction surface side separate member, 7*c* blade frame portion, 10 air-conditioning apparatus main body, 10*a* top plate, 10*b* side plate, 10*c* main body air inlet, 10*d* main body air outlet, 11 decorative panel, 11*a* air inlet grille, 11*b* panel air outlet, 12 filter, 13 air-directing vane, 14 bell mouth, 15 fan motor, 16 heat exchanger, 17 room, A fan rotation direction, O rotation axis, H1 length in a direction perpendicular to the blade leading edge portion 4*a*, H2 length in a direction perpendicular to the blade trailing edge portion 4*b*, S1 pitch in a direction along the blade leading edge portion 4*a*, S2 pitch in a direction along the blade trailing edge portion 4*b*, t1 height in the thickness direction of the recessed portion 5*a*, t2 height in the thickness direction of protruding portion 6*a*, U1 cutout width of the recessed portion 5*a*, U2 cutout width of the protruding portion 6*a*.

The invention claimed is:

1. A turbofan comprising:

a circular main plate to be rotationally driven;

an annular shroud disposed so as to face the main plate; and a plurality of blades that are each connected to the main plate at one end and to the shroud at the other end and that are disposed to be spaced apart in the circumferential direction of the main plate, the blades each having a blade trailing edge portion located on the outer peripheral side of the main plate, and a blade leading edge portion located closer to a center of rotation of the main plate than the blade trailing edge portion, wherein at least one of a pressure surface of the blade and a suction surface of the blade has a blade leading edge side jagged portion formed at a blade leading edge portion side of the blade, the blade leading edge side jagged portion extending substantially along the blade leading edge portion and being recessed in the thickness direction of the blade, and wherein in the blade leading edge side jagged portion, a plurality of cutout shapes are formed that are alternately protruded and recessed in a direction substantially perpendicular to the blade leading edge portion, a part from the vicinity of the blade leading edge portion to the vicinity of the blade trailing edge portion of at least one of the pressure surface of the blade and the suction surface of the blade is formed by a separate member, the separate member is fitted in a frame portion formed by the blade leading edge portion, the blade trailing edge portion, and a beam member that connects the blade leading edge portion and the blade trailing edge portion and that is thinner than the thickness of the blade, and the blade is thereby formed.

2. The turbofan of claim 1, wherein the blade trailing edge portion is formed substantially perpendicularly to the main plate, and at least one of the pressure surface of the blade and the suction surface of the blade has a blade trailing edge side jagged portion formed at a blade trailing edge portion side of the blade, the blade trailing edge side jagged portion including a protruding portion extending substantially along the blade trailing edge portion and protruding in the thickness direction of the blade, and a blade trailing edge side inclined portion in which the thickness of the blade reduces toward the blade leading edge portion from the protruding portion, and a plurality of cutout shapes are formed in the blade trailing edge side jagged portion, the plurality of cutout shapes alternately protruding and receding in a direction substantially perpendicular to the blade leading edge portion.

3. The turbofan of claim 2, wherein the plurality of cutout shapes of the blade trailing edge side jagged portion have a predetermined pitch in a direction along the blade trailing edge portion, a predetermined length in a direction perpendicular to the blade trailing edge portion, and a predetermined height in the thickness direction of the protruding portion.

4. The turbofan of claim 2, wherein the blade trailing edge side inclined portion is formed with the thickness of the blade gradually decreasing from the protruding portion toward the blade leading edge portion.

5. The turbofan of claim 1, wherein the separate member is fitted in the frame portion in such a manner that a gap is formed between the separate member and the beam member, and a hollow space is thereby formed within the blade.

6. The turbofan of claim 1, wherein the plurality of cutout shapes each have a substantially triangular or trapezoidal shape in side view.

7. An air-conditioning apparatus comprising:

a casing having an air inlet through which air is taken in and an air outlet through which air is blown out;

the turbofan of claim 1 disposed within the casing;

a motor rotationally driving the main plate of the turbofan; and a heat exchanger disposed around the turbofan.

8. The turbofan of claim 1, wherein the blade leading edge side jagged portion has a recessed portion recessed in the thickness direction of the blade and a blade leading edge side inclined portion in which the thickness of the blade increases toward the blade trailing edge portion from the recessed portion.

9. The turbofan of claim 8, wherein the plurality of cutout shapes of the blade leading edge side jagged portion have a predetermined pitch in a direction along the blade leading edge portion, a predetermined length in a direction perpendicular to the blade leading edge portion, and a predetermined height in the thickness direction of the recessed portion.

10. The turbofan of claim 8, wherein the blade leading edge side inclined portion is formed with the thickness of the blade gradually increasing from the recessed portion toward the blade trailing edge portion.

11. The turbofan of claim 1, wherein a part of the blade leading edge portion adjacent the main plate forms a blade inner peripheral side leading edge portion that is substantially perpendicular to the main plate, and a part of the blade leading edge portion adjacent the shroud forms a blade shroud side leading edge portion that extends at an increasing incline defined by the blade leading edge portion becoming closer to the blade trailing edge portion as distances of the blade leading edge portion and blade trailing edge portion from the main plate increase.

12. The turbofan of claim 1, wherein the plurality of cutout shapes of the recessed portion of the blade leading edge side jagged portion are consecutively formed.

13. The turbofan of claim 1, wherein the plurality of cutout shapes of the recessed portion of the blade trailing edge side jagged portion are consecutively formed.

* * * * *